US005370455A

United States Patent [19]

Sedovic et al.

[11] Patent Number: 5,370,455

[45] Date of Patent: Dec. 6, 1994

[54] REFRIGERATOR DOOR MODULE ASSEMBLY

[75] Inventors: John A. Sedovic; Thomas E. Jenkins, both of Louisville, Ky.

[73] Assignee: General Electric Company, Louisville, Ky.

[21] Appl. No.: 10,657

[22] Filed: Jan. 28, 1993

[51] Int. Cl.[5] ..... F25D 11/00

[52] U.S. Cl. ..... 312/405.1; 312/321.5

[58] Field of Search ..... 312/405.1, 321.5, 312, 312/248; 248/239; 108/109, 110; 211/193, 187, 103

[56] References Cited

U.S. PATENT DOCUMENTS

| | | | |
|---|---|---|---|
| 2,898,173 | 8/1959 | Squire | 312/248 |
| 3,029,953 | 4/1962 | Morrissey, Jr. | 211/147 |
| 3,807,822 | 4/1974 | Amore | 312/138 |
| 4,859,010 | 8/1989 | Jeziorowski | 312/312 |
| 4,867,512 | 9/1989 | Wilkins et al. | 312/245 |
| 4,908,544 | 3/1990 | Lau | 312/321.5 |

*Primary Examiner*—Kenneth J. Dorner
*Assistant Examiner*—Gerald A. Anderson
*Attorney, Agent, or Firm*—H. Neil Houser

[57] ABSTRACT

A storage module assembly for a refrigerator door having an outer shell and an inner liner. The liner includes a rear wall and a pair of side walls forming a recess. The side walls have vertically spaced apart, horizontally aligned pairs of module mounting bosses. Each boss includes top and bottom walls joined by side walls which diverge in the downward direction. Each module includes a bottom wall and side walls positionable adjacent the liner side walls. The module side walls include slots with horizontal portions open to the rear and vertical portions at their opposite ends. The vertical portions have downwardly diverging side walls and receive the bosses in a conforming overfitting manner. A module is mounted in the door by sliding the horizontal portions of the slots over the bosses and then moving the module downward to seat the bosses in the vertical portions.

4 Claims, 1 Drawing Sheet

REFRIGERATOR DOOR MODULE ASSEMBLY

BACKGROUND OF THE INVENTION

This invention relates to storage module assemblies for refrigerator doors and, more particularly, to such assemblies which are flexible and easy to use and securely restrain the modules during door operation.

Modern refrigerators normally include door mounted modules, in the form of drawers, trays or shelves, to store items which are used frequently. A number of schemes have been introduced to improve the flexibility of such assemblies, particularly to provide for mounting the modules at various locations on the door liner in order to accommodate items of varying heights. Such modules are not permanently attached to the liner and are subject to being forced off their mountings when the door is opened and closed. Various approaches have been used to restrain the modules during door operations. None of the prior assemblies provides an optimal marriage of flexibility of use and ease of installation and removal coupled with positive restraint during door operations.

The present invention provides a module mounting assembly which provides great flexibility of the locations at which modules may be mounted on the door liner. The modules are easily mounted and removed while, at the same time, they are positively restrained during door openings and closings.

SUMMARY OF THE INVENTION

A refrigerator door storage module assembly includes a refrigerator door having an outer casing and an inner liner. The liner includes a rear wall and spaced apart side walls forming a recess. At least one pair of opposing module supporting bosses project inwardly of the door liner side walls. Each boss includes top and bottom walls joined by side walls which diverge in the downward direction. At least one module is receivable in the door liner recess. The module includes a bottom wall and side walls positionable adjacent the door liner side walls. The module side walls include at least one slot having a horizontal portion open to the rear and a vertical portion extending upward at the opposite end of the horizontal portion. The vertical portions include top walls and depending side walls which diverge in the downward direction. The vertical slot portions are sized to fit closely about the top and side walls of the bosses. A module is mounted to the door liner by sliding the horizontal portion of a pair of slots over a corresponding pair of bosses until the bosses align with the vertical slot portions and then lowering the module until the bosses are seated in the vertical portions. The height of the horizontal portions is made just slightly larger than the height of the bosses to guide the modules without binding.

Greater flexibility is achieved by providing the liner with a vertically spaced series of horizontally aligned pairs of bosses. In addition fine adjustment of the mounting positions is provided by including at least two vertically spaced slots on each side of the modules.

DESCRIPTION OF THE PREFERRED EMBODIMENTS

Figure 2:
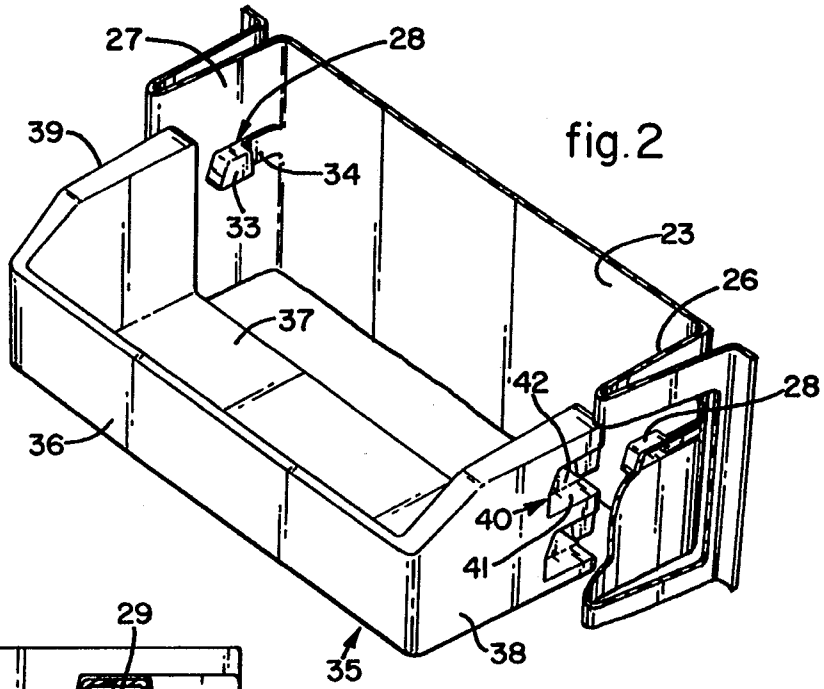
FIG. 2 is a fragmentary, exploded view of a module and a portion of the liner of the fresh food door of FIG. 1.
Figure 4:
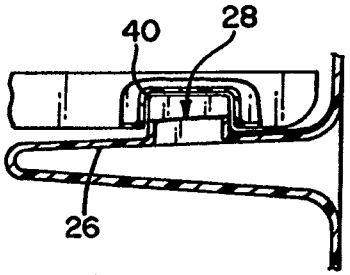
FIG. 4 is a fragmentary cross sectional view further illustrating seating of the boss in the module slot.
Figure 3:
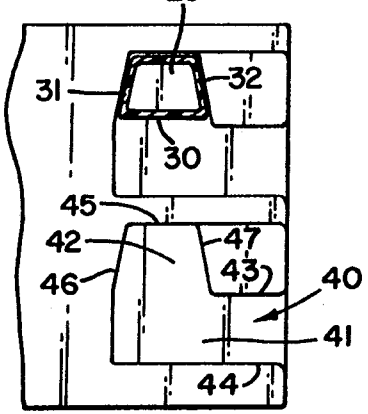
FIG. 3 is a fragmentary side elevation view of the module of FIG. 2, illustrating seating of a boss in a module slot.
Figure 1:
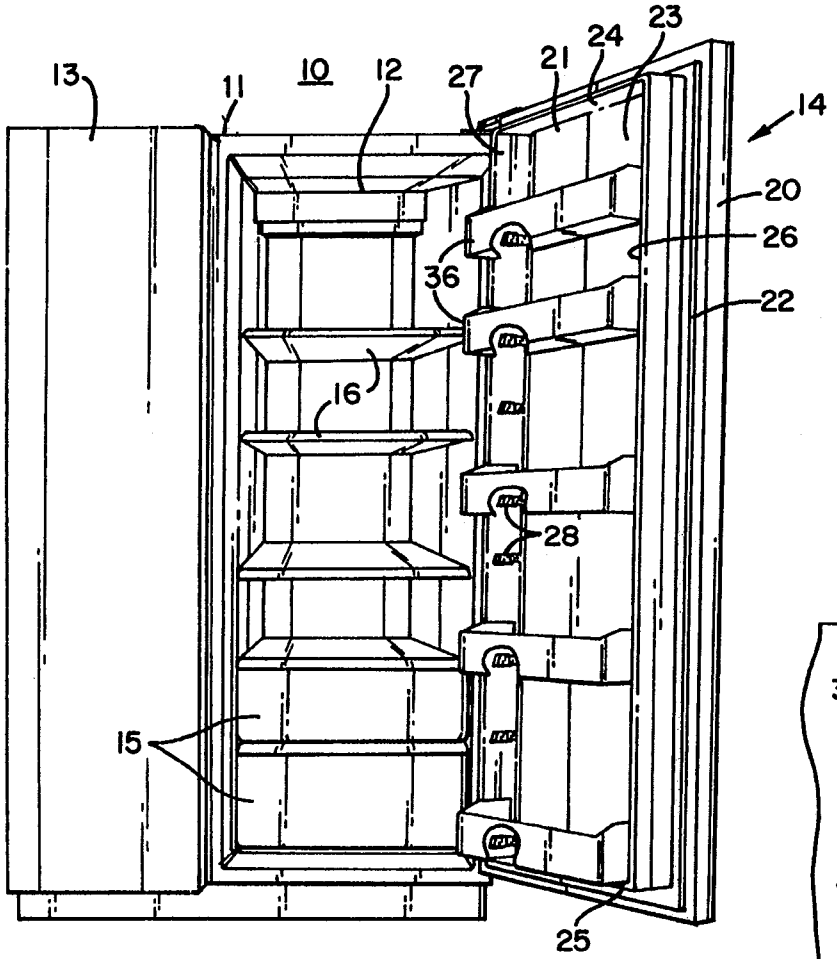
FIG. 1 is a simplified front view of a side-by-side refrigerator, with the fresh food compartment door open to show a door storage module assembly in accordance with one embodiment of the present invention.

Referring now particularly to FIG. 1, there is shown a side-by-side refrigerator 10; that is the cabinet 11 includes a freezer compartment, not shown, and a fresh food compartment 12 arranged in a side-by-side configuration. Each of the compartments has a front access opening which is normally closed by hinged doors 13 and 14. Typically, drawers 15 and shelves 16 are provided in compartment 12 to support various items to be refrigerated.

The door 14 includes an outer shell or casing 20 and an inner liner 21. The space between them normally is filled with an insulation material, such as, for example, a body of foamed-in-place insulation. A gasket 22 extends around the periphery of the door and engages the cabinet when the door is closed to prevent air leakage. The inner liner 21 includes a rear wall 23 as well as a top wall 24, a bottom wall 25 and spaced apart side walls 26, 27. The top, bottom and side walls extend forward from the rear wall to form a recess in the liner which faces into and becomes an effective part of fresh food compartment 12 when door 14 is closed.

Such door recesses are utilized to store items which are not too bulky and particularly items which are used frequently. To this end each side wall 26, 27 is provided with a series of vertically spaced apart bosses 28. The bosses on each wall are horizontally aligned with corresponding bosses on the side other wall and all the bosses are spaced a predetermined distance from the rear wall. Preferably the door liner 21 is molded from a suitable plastic material and the bosses are integrally molded with the liner. However, it will be understood that the bosses may be formed separately and mounted to the liner if desired.

Each of the bosses is shaped in cross section like a truncated triangle, having generally horizontal top and bottom walls 29, 30 joined by side walls 31, 32. The side walls diverge in the downward direction; that is, they are further apart at the longer bottom wall 30 than they are at the shorter top wall 29. A trapezoidal face 33 joins the edges of the walls 29–32. A small runner extends rearwardly from each boss 28 and blends into the liner 21 at the rear wall 23. These runners result from the molding process forming the liner 21 and are not an integral part of the module assembly.

A number of storage modules 35 are mounted on the door inner liner 21 by means of the bosses. Each of the illustrative modules 35 includes a front wall 36, a bottom wall 37 and a pair of side walls 38, 39. The side walls 38, 39 are so spaced apart that, when the module is inserted in the recess in the door liner, the module walls 38, 39 are closely adjacent the liner side walls 26, 27 respectively. The modules 35 have open backs as they abut against the liner rear wall 23. If desired, the modules could include integral rear walls. Each module side wall is provided with a pair of slots 40. Each slot includes a horizontal portion 41, which opens to the rear of the module and extends toward the front wall 36 of the module. Each slot also includes a vertical portion 42 which extends upward from the other or front end section of the horizontal portion. The height of the horizontal slot portions, between upper walls 43 and lower walls 44, is just sufficiently greater than the height of the bosses, between top walls 29 and bottom walls 30, that the bosses will slide easily within the horizontal slot portions. The vertical portions have top walls 45 and side walls 46, 47, which diverge in the downward direction like side walls 31, 32 of the bosses. The vertical slot portions 42 are formed to closely fit about the bosses so that the bosses positively but releasably nest within the vertical slot portions when the modules are mounted on the door liner. Preferably the side walls 31, 32 and 46, 47 are formed at between 5 degrees and 30 degrees from the vertical. This assures that the user may easily mount the modules in the door and easily remove them while, at the same time, the modules are positively restrained against unwanted movement. In that way the inertia or momentum associated with opening or closing the door will not cause modules to come off the bosses.

A module 35 is mounted on the liner by inserting it horizontally into the recess between liner side walls 26, 27 with a pair of horizontally aligned bosses 28 being received in the horizontal portions 41 of a pair of aligned slots 40 in module side wall slots 40. The module 35 is moved toward the rear of the door until the bosses are alignment with the vertical portions 42 of the slots. Then the module is moved downward until the bosses seat in the vertical slot portions 43.

The series of vertically spaced bosses along the liner side walls 26, 27 provide flexibility in placement of the modules in the door and the vertically spaced slots in each module side wall adds the capability to more closely adjust the placement of the modules. For example, the bosses must to be placed apart a distance at least as far as the height of the modules, and preferably a wider distance to provide clearance for items projecting above the modules. However, multiple slots in the module side walls provide the capability to adjust the location of a module by a distance less than the height of the module.

What is claimed is:

1. A refrigerator door storage module assembly including:

a refrigerator door having an outer shell and an inner liner including side and rear walls defining a recess;

at least one pair of opposing module supporting bosses projecting inwardly of said side walls, each of said bosses including a top wall and a bottom wall joined by a pair of side walls; each of said side walls diverging outwardly of the other of said side walls in the downward direction;

at least one door storage module receivable in the recess in said door liner, said module including a bottom wall and a pair of side walls positionable adjacent said door liner side walls;

at least one pair of boss receiving slots formed in said module side walls, each of said slots including an elongated horizontal portion open to the rear of said module and a vertical portion extending upward at the opposite end of said horizontal portion each horizontal portion having a height just sufficiently greater than the height of said bosses that a boss will slide easily within that horizontal portion; each vertical portion including a top wall and a pair of side walls each of which diverges outward of the other side wall of that slot downwardly from said top wall; each vertical portion being formed to closely fit about a boss;

whereby said at least one module is assembled to said door by sliding said horizontal portions of said module slots over said bosses until said bosses are aligned with said vertical portions and then lowering said module to bring said bosses into register with said vertical portions of said slots.

2. A door module assembly as set forth in claim 1: wherein said door liner side walls include a plurality of pairs of horizontally aligned bosses vertically spaced apart more than the height of said at least one door module so that a module may be mounted in a number of selected locations within said door recess.

3. A door module assembly as set forth in claim 1: wherein each of said side walls of said at least one module include at least two vertically spaced apart slots, so that the mounting of said module on said at least one pair of module supporting bosses is vertically adjustable.

4. A module assembly as set forth in claim 1, wherein: said door liner is constructed of a molded plastic material and said bosses are formed integrally of said liner.

* * * * *